US006168522B1

(12) United States Patent
Walker et al.

(10) Patent No.: US 6,168,522 B1
(45) Date of Patent: Jan. 2, 2001

(54) METHOD AND APPARATUS FOR OPERATING A GAMING DEVICE TO DISPENSE A SPECIFIED AMOUNT

(75) Inventors: Jay S. Walker, Ridgefield; James A. Jorasch, Stamford; Magdalena Mik, Wallingford, all of CT (US)

(73) Assignee: Walker Digital, LLC, Stamford, CT (US)

( * ) Notice: Under 35 U.S.C. 154(b), the term of this patent shall be extended for 0 days.

(21) Appl. No.: 09/052,667

(22) Filed: Mar. 31, 1998

(51) Int. Cl.[7] ..... A63F 9/22
(52) U.S. Cl. ..... 463/25; 463/20
(58) Field of Search ..... 463/1, 12–13, 463/16–20, 25–30, 40–42; 273/292–293, 143 R, 138.2, 139; 700/91–93; 235/375, 380, 381, 379; 705/16–18, 35, 39, 41–45

(56) References Cited

U.S. PATENT DOCUMENTS

| | | | | |
|---|---|---|---|---|
| 4,636,951 | | 1/1987 | Harlick . | |
| 5,179,517 | | 1/1993 | Sarbin et al. . | |
| 5,275,400 | | 1/1994 | Weingardt et al. . | |
| 5,377,973 | * | 1/1995 | Jones et al. | 463/12 |
| 5,429,361 | * | 7/1995 | Raven et al. | 463/25 |
| 5,470,079 | | 11/1995 | LeStrange et al. . | |
| 5,511,781 | | 4/1996 | Wood et al. . | |
| 5,559,312 | | 9/1996 | Lucero . | |
| 5,639,088 | | 6/1997 | Schneider et al. . | |
| 5,674,128 | | 10/1997 | Holch et al. . | |
| 5,770,533 | * | 6/1998 | Franchi | 463/16 |
| 5,919,091 | * | 7/1999 | Bell et al. | 463/25 |

FOREIGN PATENT DOCUMENTS

2161008A * 1/1986 (GB) .

OTHER PUBLICATIONS

Golden Palace Online Casino Web Pages From Site at www.goldenpalace.com on Dec. 2, 1999. 16 total pages and on Dec. 3, 1999 a total of 6 pages downloaded, 1997.*
Golden Palace On–Line Casino (http://www.inspace.net/~ragoczy/gambling/goldenpalace.htm) downloaded date: Mar. 16, 1998, Review by Paul Jackson, 3 pages.
Registered VIP Cashout (http://www.207.112.121.5/html/cashout.htm) download date: Mar. 16, 1998, 1 page.

* cited by examiner

*Primary Examiner*—Mark A Sager
(74) *Attorney, Agent, or Firm*—Steven M. Santisi; Dean P. Alderucci

(57) ABSTRACT

A gaming device, such as a slot machine, determines a balance and a "dispensed amount" that is less than the balance. The dispensed amount may be determined by, for example, receiving signals from one or more key presses that specify the dispensed amount. Alternatively, the dispensed amount may be determined in accordance with one or more "balance management rules". The gaming device in turn dispenses the dispensed amount, for example, by dispensing an amount of currency, transferring the dispensed amount to an account or adjusting a balance of a remote gaming device. The balance is adjusted by the dispensed amount, and this adjusted balance is available for initiating a subsequent play of the gaming device.

20 Claims, 13 Drawing Sheets

METHOD AND APPARATUS FOR OPERATING A GAMING DEVICE TO DISPENSE A SPECIFIED AMOUNT

FIELD OF THE INVENTION

The present invention relates generally to gaming devices and more specifically to gaming devices which dispense monetary output.

BACKGROUND OF THE INVENTION

A conventional gaming device, such as a slot machine, video poker machine or video blackjack machine, typically requires a player to establish an initial "balance" with the gaming device by providing the gaming device with monetary input. For example, the player may insert currency (bill, coins and/or tokens) into the gaming device. Alternatively, the player may have funds transferred to the gaming device from an account such as a credit card account or casino account. Such an account would typically be identified by a card inserted into the gaming device. Once a balance is established, it is available for initiating a play of the gaming device.

The player then selects a wager amount, which is subtracted from the balance, and initiates a play, for example, by pulling a handle or pressing a button on the gaming device. In response, the gaming device generates a game outcome and a corresponding winning amount that is based on the game outcome. The winning amount may be zero for unfavorable game outcomes, or a greater amount for more favorable outcomes. Typically, greater winning amounts correspond to more unlikely game outcomes. The balance is increased by the winning amount, thereby generating an adjusted balance that is available for initiating a subsequent play of the gaming device.

After any number of such plays, the player may direct the gaming device to dispense the adjusted balance, thereby providing the player with monetary output. Dispensing typically includes activating a hopper in the gaming device to dispense currency to the player. Some gaming devices alternatively credit a credit card or other account with the dispensed amount, eliminating the need for the player to hold and carry dispensed currency. After dispensing, the balance of the gaming device is zero, and another initial balance must be established before subsequent plays of the gaming device may be initiated.

Dispensing the entire balance of the gaming device is often inconvenient for the player. Many players want to separate the amount used to establish an initial balance from any winning amounts awarded by the gaming device, so that the player can play with "house money" (money awarded while playing) and not "his own" money. Such players may establish an initial balance with $10, play until the balance increases (e.g. to $15), request a "cash out" (a dispensing of currency), and finally re-insert the $5 of "house money" to establish another initial balance.

A player may also require money from the gaming device while he is playing. For example, a player may desire to purchase food or drinks from a cocktail server, tip a cocktail server, or provide a companion with currency. In such situations, the player must request a cash out to dispense the balance, use a portion of the dispensed amount, and then re-supply the gaming device with the remaining amount to continue playing.

Dispensing the entire balance of the gaming device is often undesirable to the casino that profits from the gaming device. Each time a player cashes out (has currency dispensed to him), he may decide to stop playing, particularly given the need to re-supply the gaming device with more monetary input. Further, the time spent dispensing the entire balance to the player and re-supplying the gaming device with monetary input is time during which no plays can occur. Accordingly, such time represents lost profits to the casino. In addition, dispensing currency exerts wear and tear on various components of the gaming device, and may eventually require repair and/or replacement of those components.

In light of some of these drawbacks, some businesses offer similar games for personal computer users. Golden Palace is an "on-line" casino that allows a player to play several games using a computer connected to the Internet. Players establish a balance with a credit card account, bank funds transfer or check mailed to a predetermined address. That balance is adjusted accordingly by wager amounts and winning amounts. After one or more plays, the player can specify an amount of the adjusted balance to be dispensed. If a credit card account was used with the Golden Palace, the specified amount to dispense is credited back to the account, up to the total of the original credit card charges. Any remaining amount to dispense is made in the form of a bank funds transfer or check mailed to the player.

Golden Palace is limited in that it is not a gaming device, but is instead an on-line communications channel that facilitates gaming. Accordingly, Golden Palace cannot accept or dispense currency, and so many players will find the corresponding gaming experience highly unsatisfying. The delay in receiving any winnings due tends to further diminish the thrill of winning. In addition, winnings that are mailed out in the form of a check require that the player cash the check at a bank, further increasing the delay in receiving the winnings.

It would be advantageous to provide a method and apparatus that overcomes the above-described drawbacks of conventional gaming devices.

SUMMARY OF THE INVENTION

The present invention overcomes the above-described drawbacks of conventional gaming devices by providing a gaming device in which a player can specify a portion of a balance to be dispensed.

In accordance with the present invention, a gaming device, such as a slot machine, determines a balance and a "dispensed amount" that is less than the balance. The dispensed amount may be determined by, for example, receiving signals from the actuation of one or more keys, in which the signal specifies the dispensed amount. Alternatively, the dispensed amount may be determined in accordance with one or more "balance management rules". The gaming device in turn dispenses the dispensed amount, for example, by dispensing an amount of currency. Alternatively, the gaming device permits transferring the dispensed amount to an account or adjusting a balance of a remote gaming device. The balance is adjusted by the dispensed amount, and this adjusted balance is available for initiating a subsequent play of the gaming device.

DETAILED DESCRIPTION OF THE PREFERRED EMBODIMENTS

Figure 1:
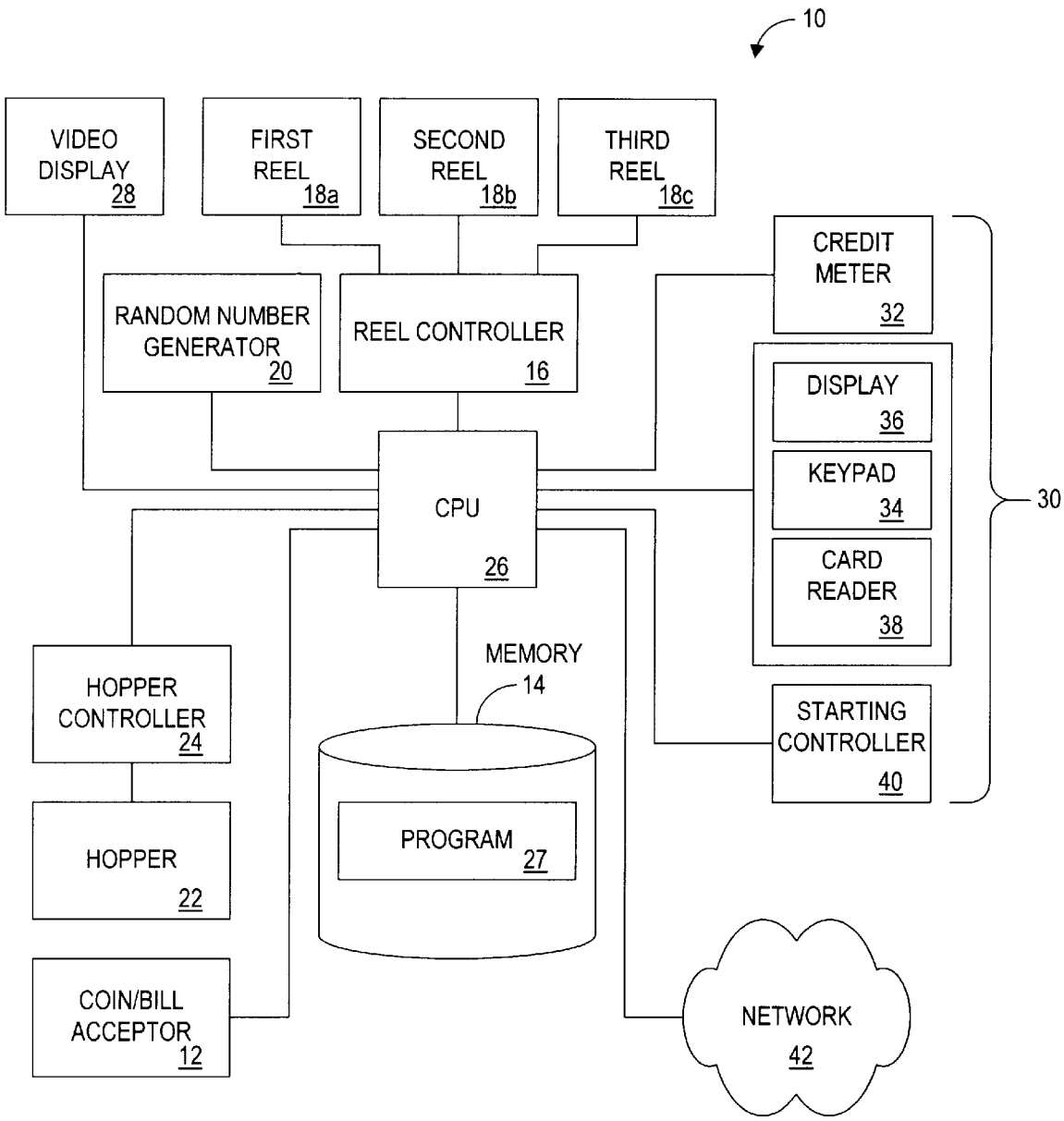
FIG. 1 is a block diagram of a slot machine provided in accordance with the present invention.

Referring now to FIG. 1, a slot machine 10 includes a coin/bill acceptor 12 for accepting coins, bills and tokens, thereby allowing a player to establish a balance with the slot machine 10. The slot machine 10 also includes a memory 14 for storing the balance and other data described below, such as a table of outcomes, probabilities of the outcomes and corresponding winning amounts for the outcomes.

The slot machine 10 further includes a reel controller 16, a set of reels 18*a*–18*c* in communication therewith, and a random number generator 20. In response to the initiation of play, the random number generator 20 and the reel controller 16 operate to determine and display an outcome defined by a combination of reel positions. The initiation of play causes the reels 18*a*–*c* to spin under the control of the reel controller 16, and to stop at the specified combination reel positions. The slot machine 10 further includes a hopper controller 24 and a hopper 22 in communication therewith. The hopper 22 stores a supply of currency, and the hopper controller 24 controls the amount of currency to be received by or dispensed from the hopper 22.

The slot machine 10 further includes a central processing unit (CPU) 26 which is in communication with the coin/bill acceptor 12, the memory 14, the reel controller 16, the random number generator 20 and the hopper controller 24. The CPU 26 provides control functions described in more detail below. A program 27 stored in the memory directs the CPU 26 in accordance with the present invention, and particularly in accordance with the processes described in detail hereinafter.

The slot machine 10 may also include a video display 28, in communication with and controlled by the CPU 26, to display the outcome of a play. Such a video display 28 may be provided in addition to, or instead of, the set of reels 18*a*–18*c*. A player interface 30, also in communication with and controlled by the CPU 26, comprises a credit meter 32 for displaying the player's balance, a keypad 34 for entering data, a display 36 for displaying the data, error messages and other information, and a card reader 38 for reading a player's card. The keypad 34 may include electromechanical buttons, a touch screen, or any other suitable data input means that allows the player to request an amount to be dispensed from the slot machine.

The slot machine 10 can be operatively connected to a network 42. Such a connection allows the slot machine 10 to access account information, verify account status, and allows balances to be dispensed or transferred between gaming devices. Also in communication with the CPU 26 is a starting controller 40, which the player operates to initiate a play. The starting controller 40 may be, for example, a handle pulled by the player or a button actuated by the player.

Figure 2:
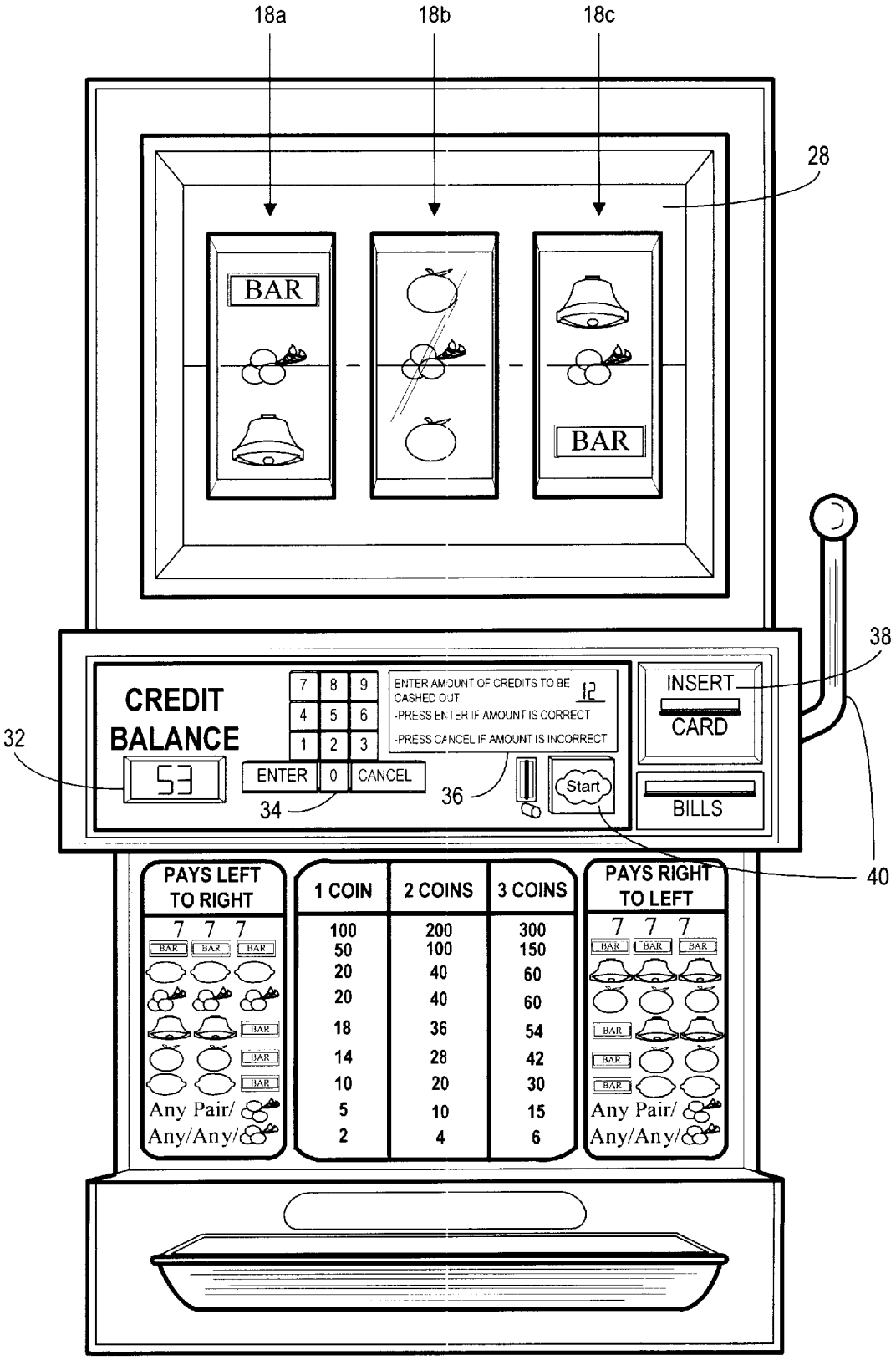
FIG. 2 is a rendering of an embodiment of the slot machine of FIG. 1.

Referring to FIG. 2, a first embodiment of a slot machine according to the present invention is shown from a player's perspective. The slot machine of FIG. 2 includes the video display 28 for displaying the positions of reels 18*a*–*c*, the credit meter 32, the keypad 34, the display 36, the card reader 38, and the starting controller 40. In the illustrated embodiment, the keypad 34 is a 10-digit keypad which enables a player to numerically enter an amount to be dispensed, and the display 36 displays a numeric value representing the amount entered.

Figure 3:
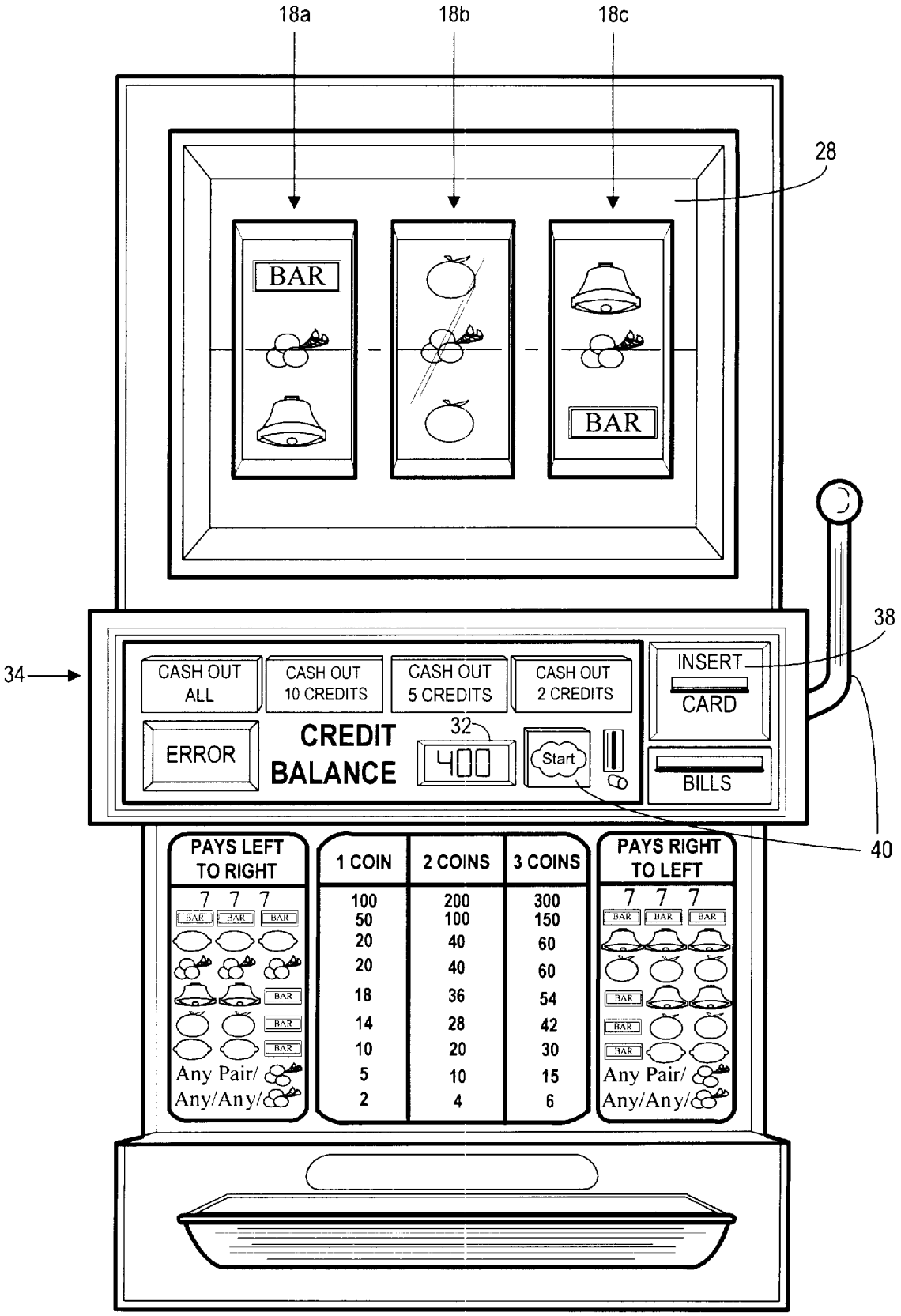
FIG. 3 is a rendering of another embodiment of the slot machine of FIG. 1.

Referring to FIG. 3, a second embodiment of a slot machine according to the present invention is shown. The embodiment of FIG. 3 is similar to the embodiment of FIG. 2, except that the keypad 34 shown in FIG. 3 includes four keys which enable a player to select one of four predetermined amounts to dispense ("all credits", "ten credits", "five credits", or "two credits"). The keypad 34 may include any number of keys, each corresponding to a different amount to dispense. Keys can also be provided to enable the player to request a percentage of the balance to be dispensed (e.g., to dispense one-half of the balance).

Figure 4A:
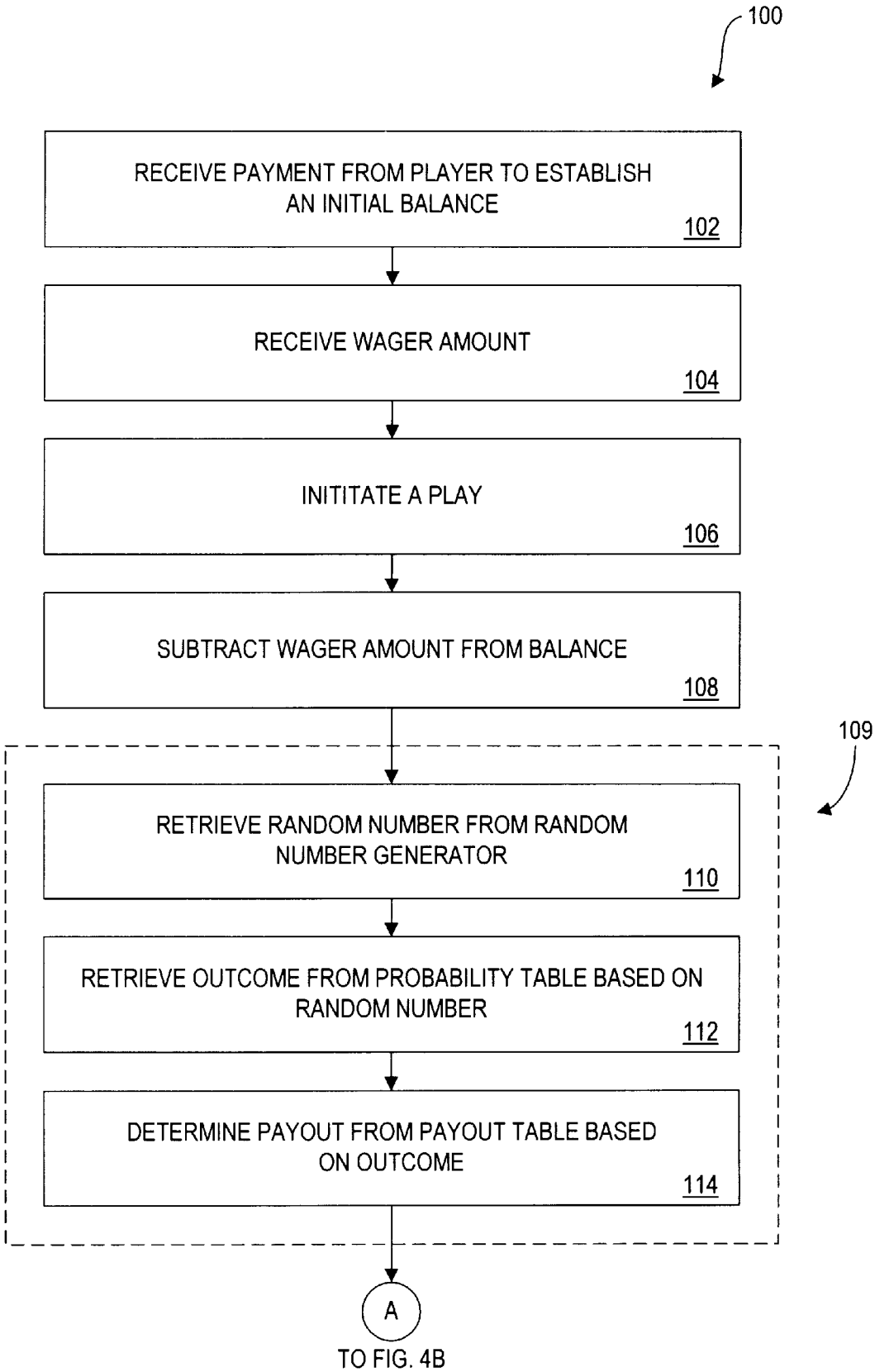
FIGS. 4A and 4B are a flow chart illustrating a method of operating a gaming device according to the present invention.
Figure 4B:
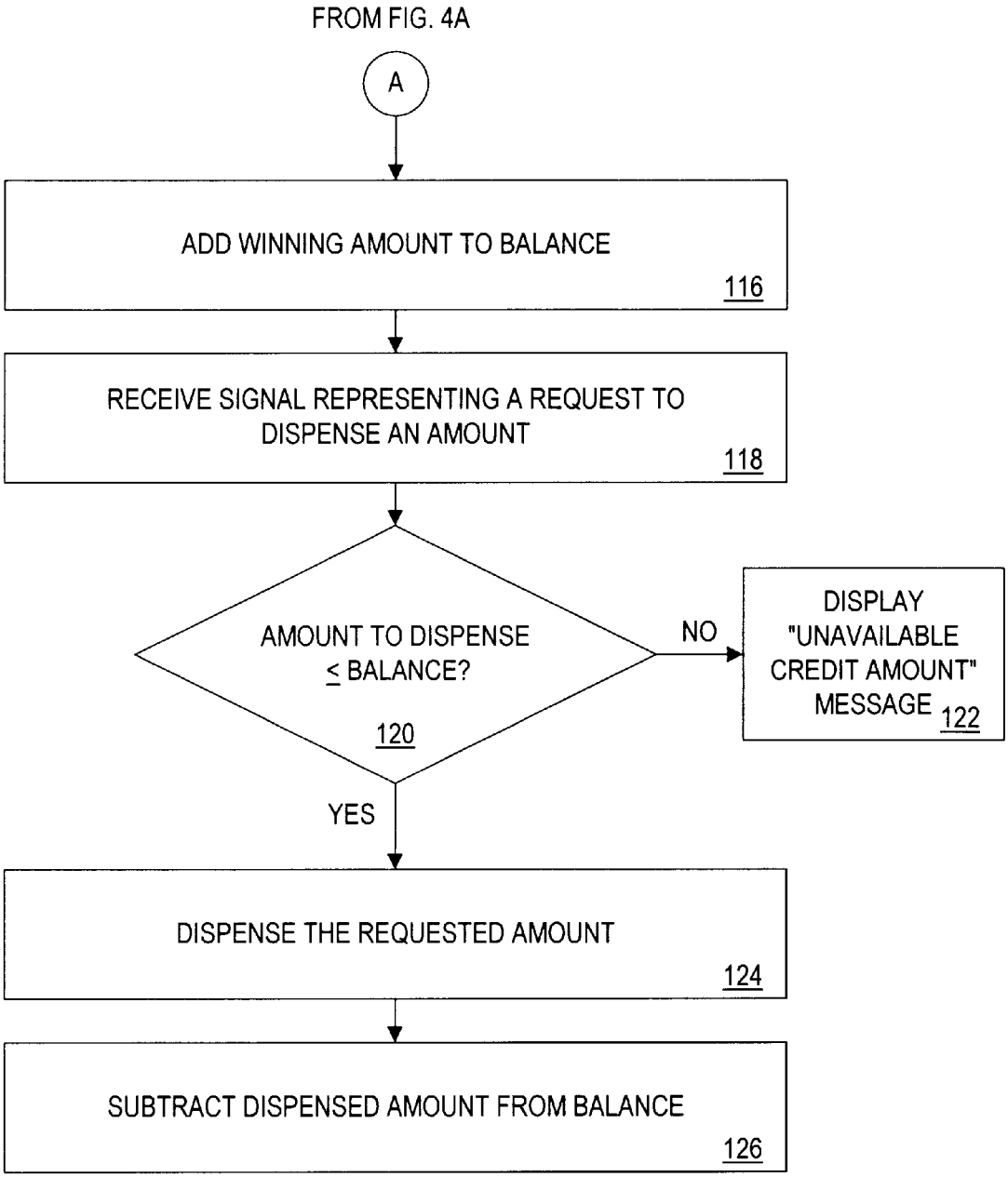

Referring now to FIGS. 4A and 4B, a flow chart illustrates a process 100 for operating a gaming device to provide a monetary output. The gaming device first establishes a balance after payment is received from the player (step 102), and then receives a wager amount (step 104), typically when the player presses a key indicating the wager amount. A play of the gaming device is initiated in response to the player activating the starting controller (step 106). The wager amount is subtracted from the balance (step 108), and the remaining balance is displayed on the credit meter 32 (FIG. 1).

In response to the initiation of play, the gaming device generates a game outcome and a corresponding winning amount that is based on the game outcome, as collectively indicated by reference numeral 109. Typically, the game outcome and winning amount are generated by (i) retrieving a random number (step 110), (ii) retrieving an outcome based on the random number from a probability table (step 112), and (iii) determining a winning amount based on the random number from a payout table (step 114). In a slot machine, the reel controller would also direct the reels to spin and finally stop at positions corresponding to the outcome.

The balance is increased by the winning amount, thereby generating a first adjusted balance that is available for initiating a subsequent play of the gaming device (step 116). Thereafter, the gaming device receives a signal representing a request to dispense an amount (step 118). In accordance with the present invention, the amount may be less than the first adjusted balance. If the requested amount to dispense is greater than the balance, then the gaming device displays a suitable message to the player (steps 120 and 122). Otherwise, the gaming device dispenses the requested amount (step 124), and the dispensed amount is subtracted from the first adjusted balance (step 126), yielding a second adjusted balance. If the second adjusted balance is zero, a balance must again be established before play can resume.

The above described step 124 of dispensing the requested amount may include dispensing an amount of currency that is based on the requested amount. More specifically, the gaming device may activate the hopper 22 (FIG. 1) to dispense an amount of currency that is based on the requested amount. Alternatively, the gaming device may transfer the requested amount to an account, such as a credit card account or an account maintained with the casino.

In another embodiment, the step 124 of dispensing the requested amount may include transferring the requested amount to another gaming device. In such an embodiment, the gaming device would be in communication with a remote gaming device, for example, through a casino-wide communications network. The gaming device would adjust the balance of the remote gaming device, adding the dispensed amount thereto. Such a transfer among gaming devices is especially advantageous in that players may share funds. For example, if a husband and wife are playing at different slot machines, and the husband runs out of funds (reaches a balance of zero), he can send a request that his wife transfer some portion of her balance to his slot machine. Alternatively, the wife may initiate such a transfer on her own.

Figure 5:
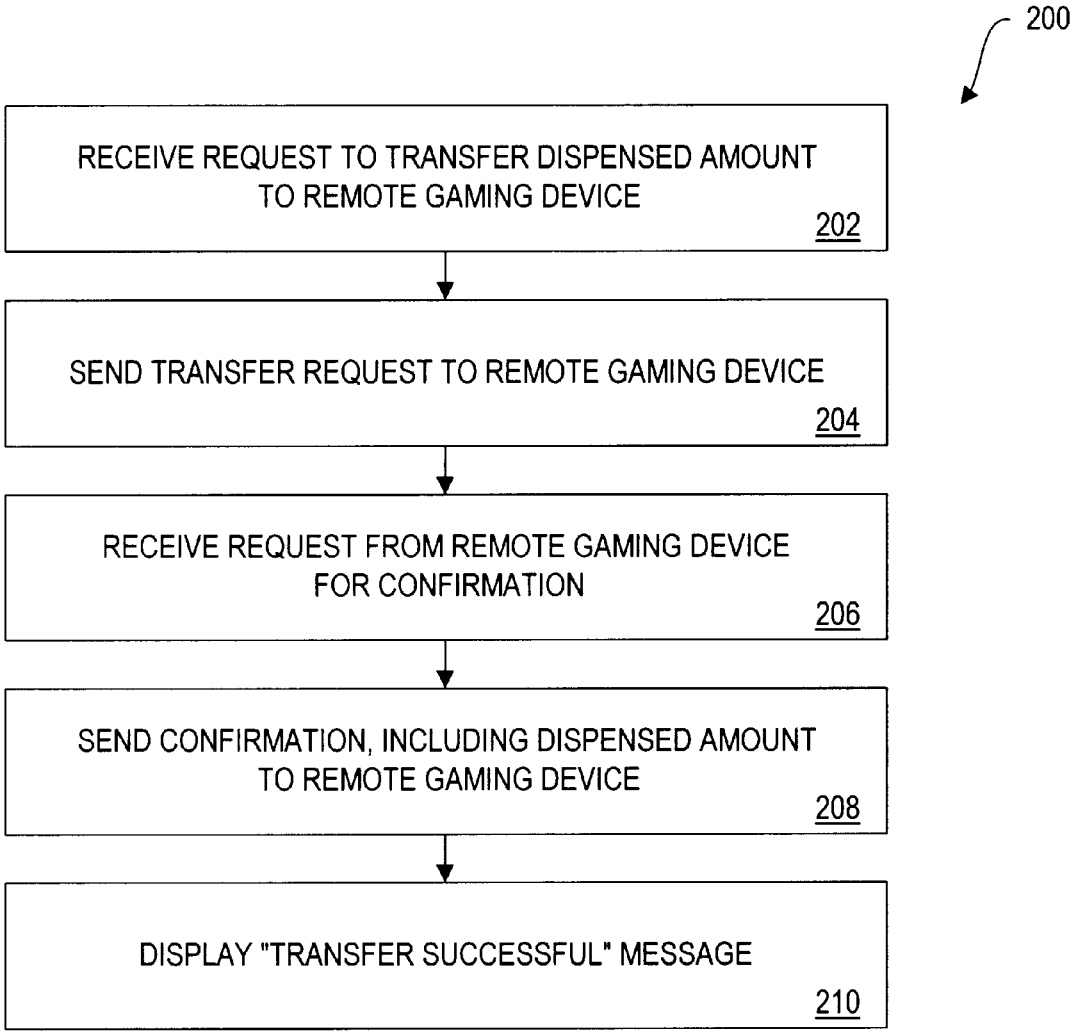
FIG. 5 is a flow chart illustrating a process for dispensing that is performed by a source gaming device.

Referring to FIG. 5, a process 200 represents one embodiment of the above-described step 124 (FIG. 4B) of dispensing. The gaming device ("source gaming device") receives from the player a request to transfer an amount to dispense (hereinafter a "dispensed amount") to a remote gaming device (step 202). The request specifies the remote gaming device in an appropriate manner. For example, the player may enter a unique identifier of the remote gaming device. Alternatively, the player may be presented with a list of players who are currently using "player tracking cards" with gaming devices on the network. Such player tracking cards typically identify players by name, thus facilitating the selection of a remote gaming device by the name of the corresponding player. It may be further advantageous to require that the player enter a password when requesting a transfer.

After the request is received, the source gaming device sends the transfer request through the network to the remote gaming device (step 204). The remote gaming device thus receives an indication of the dispensed amount and an identifier of the source gaming device. To prevent erroneous transfers, the remote gaming device responds by requesting confirmation of the requested transfer. The source gaming device receives this request for confirmation (step 206), and sends back a confirmation (step 208) which again indicates the dispensed amount. Finally, the source gaming device displays an appropriate message (step 210) to indicate to the player that the transfer was successful.

Figure 6:
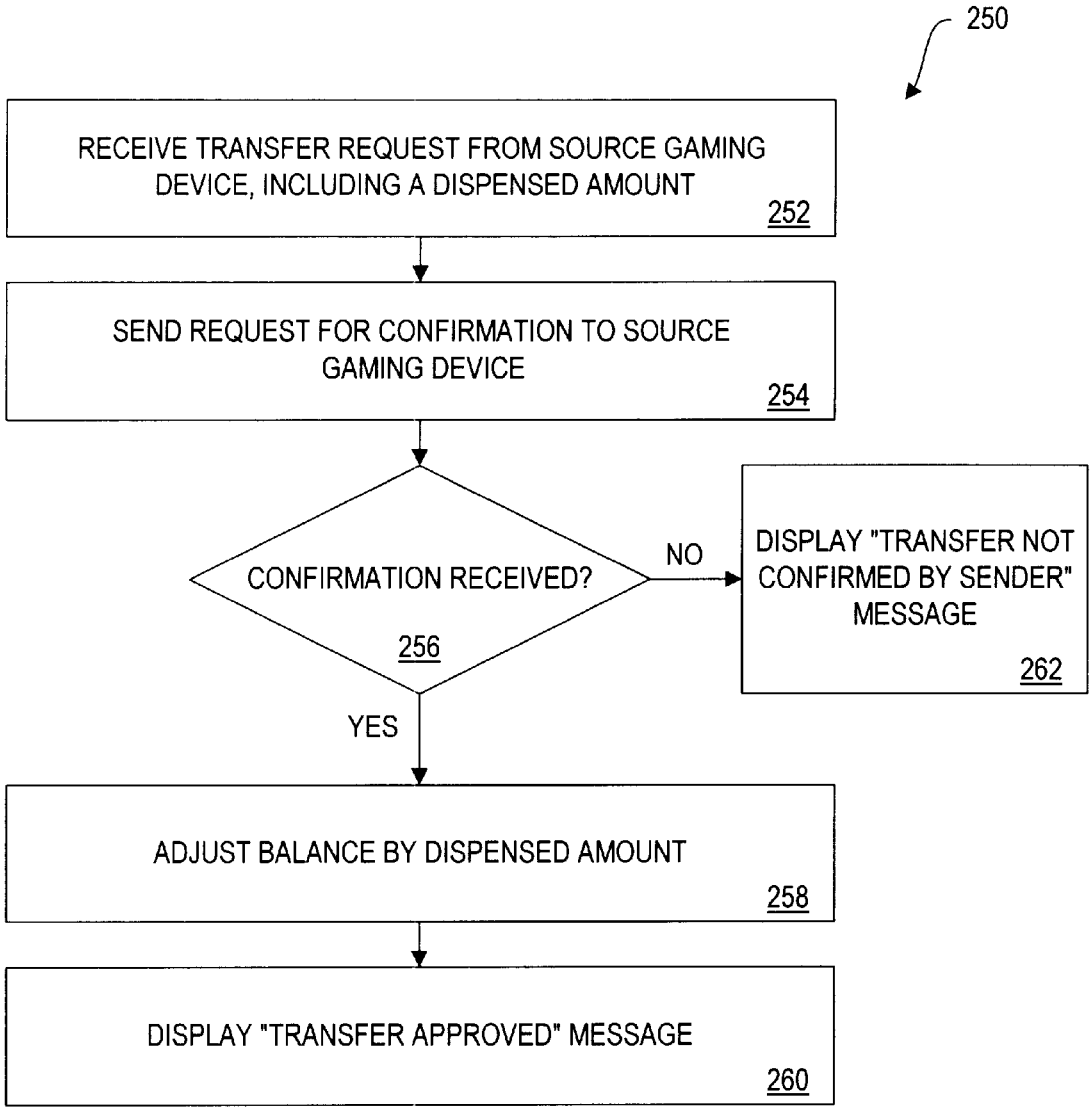
FIG. 6 is a flow chart illustrating a process for dispensing that is performed by a remote gaming device.

FIG. 6 describes a process 250 performed by the remote gaming device while the source gaming device performs the process 200 (FIG. 5). The remote gaming device first receives the transfer request from the source gaming device (step 252). As described above, this request includes an indication of the dispensed amount and an identifier of the source gaming device. The remote gaming device then sends a request for confirmation to the identified source gaming device (step 254). If the remote gaming device receives confirmation (step 256), then its balance is adjusted by the dispensed amount (step 258) and the remote gaming device displays an appropriate message indicating that the transfer was approved (step 260). Such a message may also identify the dispensed amount and the source gaming device. If the remote gaming device does not receive confirmation, then a corresponding message is displayed (step 262).

Figure 7:
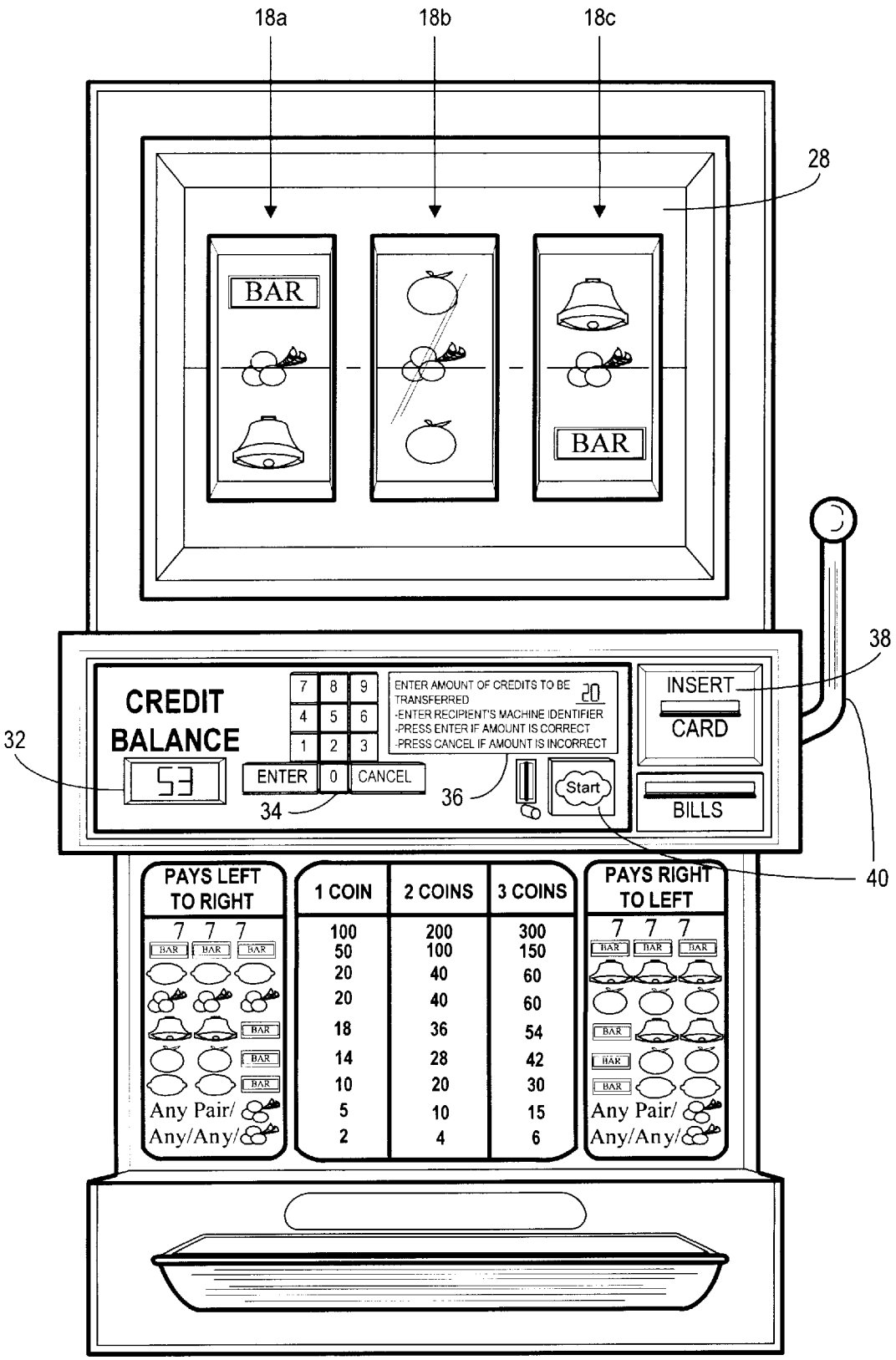
FIG. 7 is a rendering of another embodiment of the slot machine of FIG. 1.

Referring to FIG. 7, the display 36 of a source slot machine shows text which is presented to the player when he has requested a transfer to a remote slot machine (not shown). As illustrated, the display includes appropriate messages such as an indication of the dispensed amount, and instructions for indicating the remote slot machine. Analogously, the display of the remote slot machine would show text, such as "Player of machine X requests a transfer of Y credits to this machine", and "Press enter to accept transfer or cancel to reject transfer".

Although in the above-described processes a player of the source gaming device initiated the transfer, in another embodiment the player of the remote gaming device may initiate the transfer by first sending such a request to the source gaming device. Thereafter, the processes described above would proceed accordingly in a manner that will be understood by those skilled in the art.

As described above, the gaming device may determine the dispensed amount by receiving a signal that specifies the dispensed amount. Such a signal may be generated by the player pressing one or more keys on the keypad 34 (FIG. 1). In another embodiment, the dispensed amount may be determined in accordance with one or more balance management rules. Such balance management rules may be entered by the player, or may be selected after the player is presented with a list of possible rules.

Figure 8:
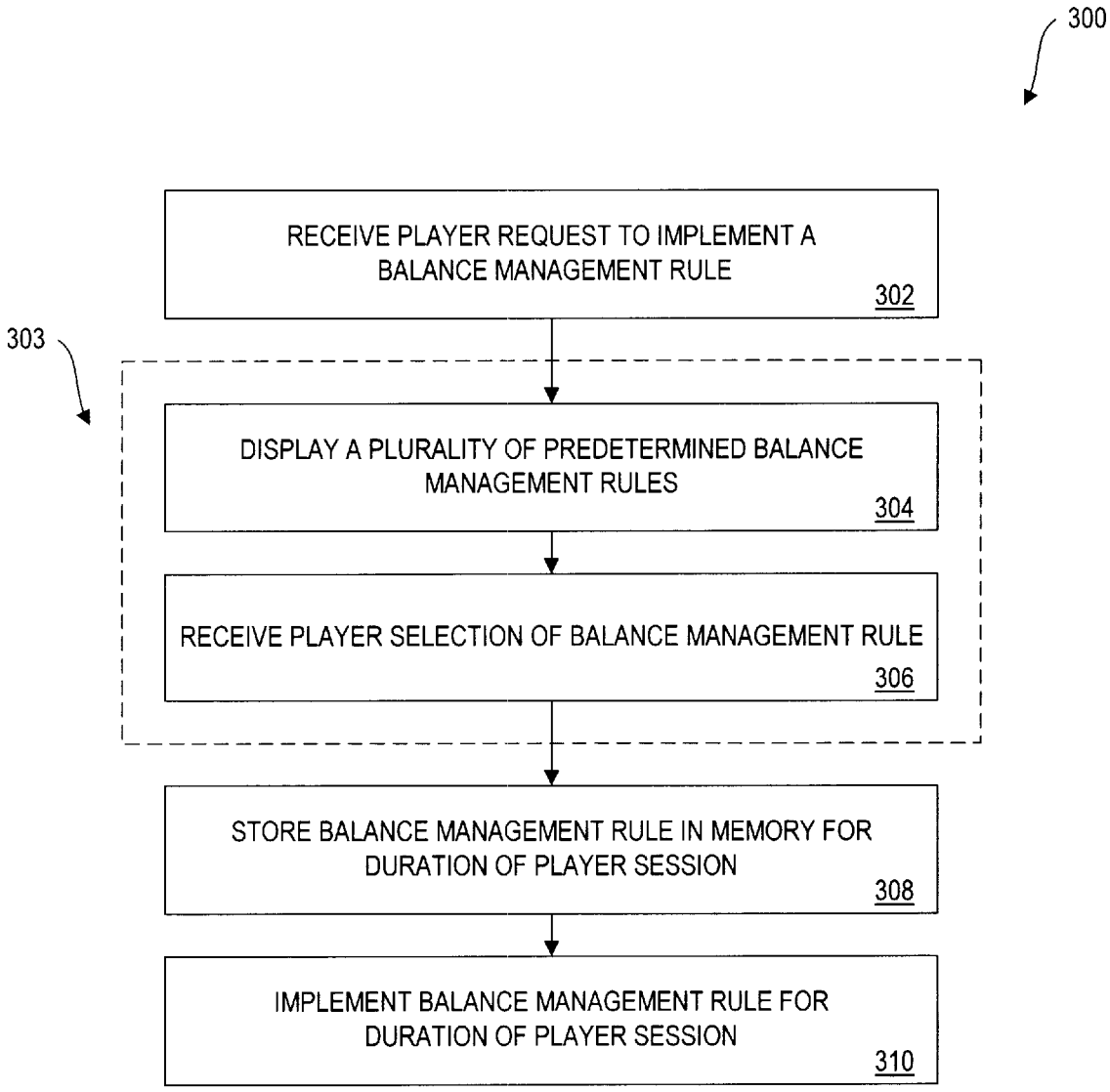
FIG. 8 is a flow chart illustrating a process for determining a dispensed amount in accordance with a balance management rule.

Referring to FIG. 8, a process 300 initiates when the gaming device receives a request to implement a balance management rule (step 302). The player then indicates the rule or rules he would like implemented, as indicated by reference numeral 303. Typically, the player indicates his desired rules by selecting from a list of possible rules. For example, the gaming device may store in the memory 14 (FIG. 1) a plurality of predetermined rules, or a player tracking card inserted into the gaming device may indicate a plurality of predetermined rules. Accordingly, the gaming device would display the plurality of predetermined balance management rules (step 304) and in turn receive the player's selection of one or more balance management rules therefrom (step 306).

In another embodiment, the player may indicate the rule he would like implemented by entering the rule through keys on the keypad 34 (FIG. 1) or through another appropriate input device. In still another embodiment, the player tracking card may indicate the rules to implement, rather than a plurality of rules from which to select those to be implemented. Inserting the player tracking card into the gaming device would load the indicated rules into the memory 14 (FIG. 1).

Once the player indicates the rule, the rule is stored in the memory 14 for the duration of the player session (step 308), and the rule is in turn implemented for the duration of the player session (step 310). The duration of the player session may be the time period during which the player tracking card remains inserted in the gaming device. Alternatively, the duration may be defined such that the session lasts until the entire balance is dispensed (i.e., the balance reaches zero).

Figure 9:
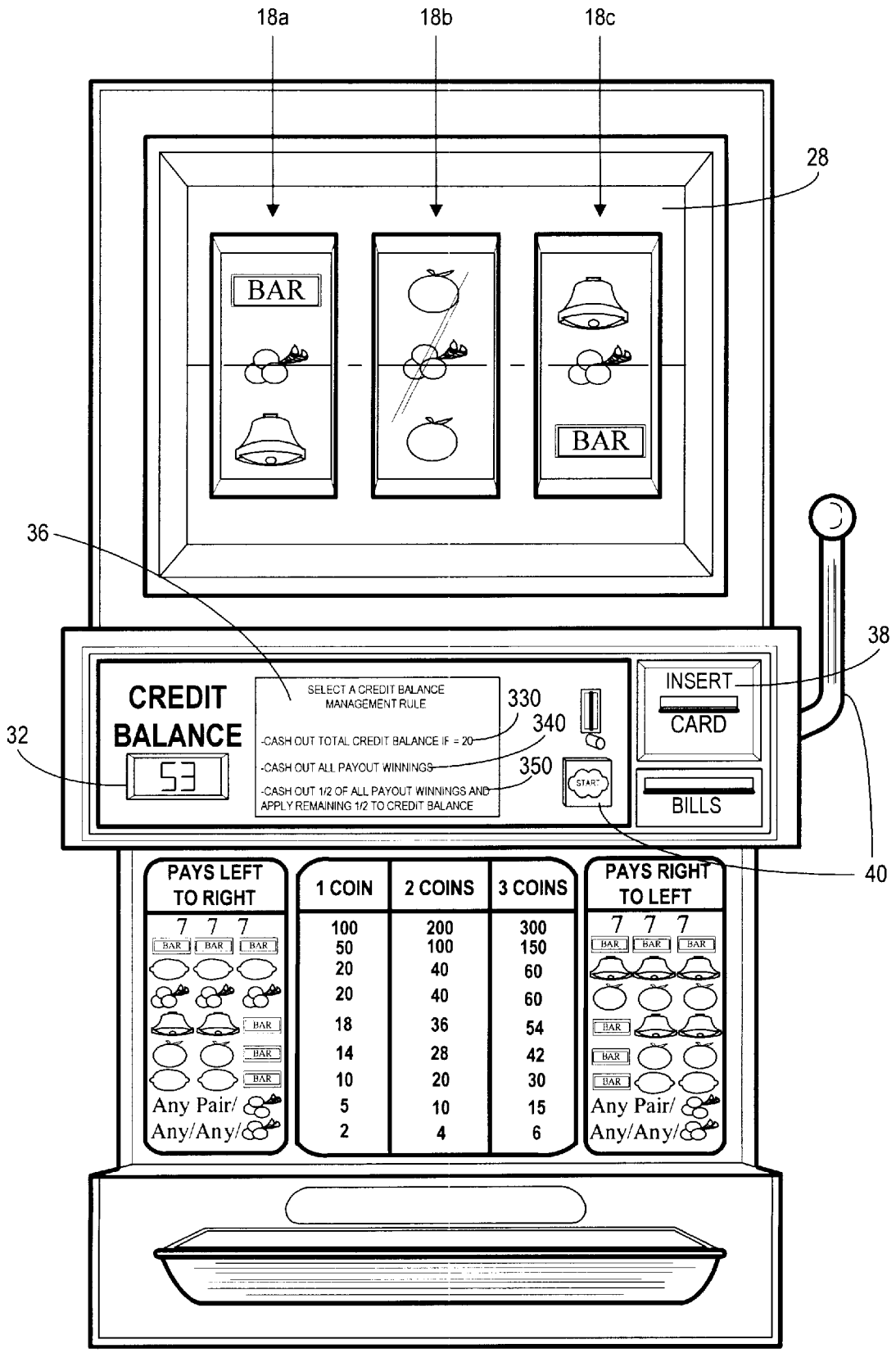
FIG. 9 is a rendering of another embodiment of the slot machine of FIG. 1.

Referring to FIG. 9, the display 36 of a slot machine shows text which is presented to the player when he has requested to implement a balance management rule. As illustrated, the displayed text indicates three possible rules 330, 340 and 350. The player would select from the three possible rules 330, 340 and 350 in any of the manners described above.

A balance management rule may specify that the dispensed amount be the difference between the balance and a predetermined threshold. Such a rule would thus specify that any winnings above the predetermined threshold be dispensed. For example, the rule may specify that each time the balance exceeds $50, an amount is dispensed to reduce the balance to $50. Furthermore, such a rule may specify that the predetermined threshold is the initial balance (the amount first provided to establish a balance). Accordingly, any winnings would be dispensed to the player.

Figure 10:
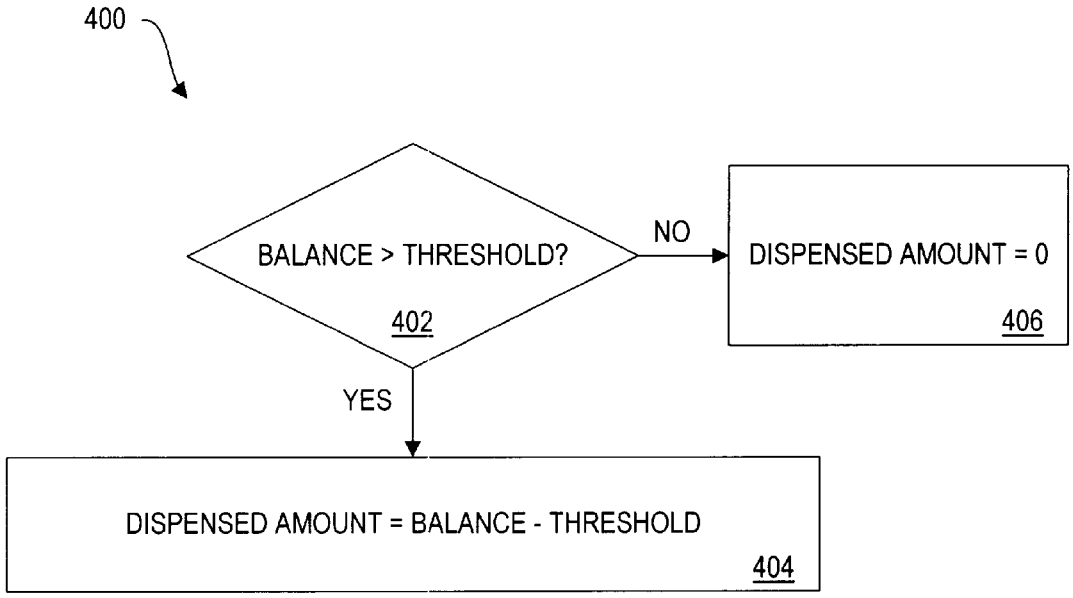
FIG. 10 is a flow chart illustrating a process for determining a dispensed amount in accordance with a first balance management rule.

Referring to FIG. 10, a process 400 for determining a dispensed amount in accordance with such a rule initiates with a determination of whether the balance exceeds the predetermined threshold (step 402). Typically, this determination is made upon each play of the gaming device. If the balance exceeds the predetermined threshold, then the dispensed amount is determined to be the difference between the balance and the predetermined threshold (step 404). Otherwise, the dispensed amount is determined to be zero (step 406), and nothing is automatically dispensed.

Another balance management rule may specify that the dispensed amount be a predetermined percentage of a difference between the balance and a predetermined threshold. For example, the rule may specify that half of the amount of the balance above $50 is dispensed after each play. In accordance with such a rule, if the predetermined threshold is $50, the predetermined percentage is 50%, and the balance is $70, then the dispensed amount is $10 (50% of ($70–$50)=$10). The predetermined threshold may be the initial balance, so that a predetermined percentage of total winnings are dispensed after each play.

Figure 11:
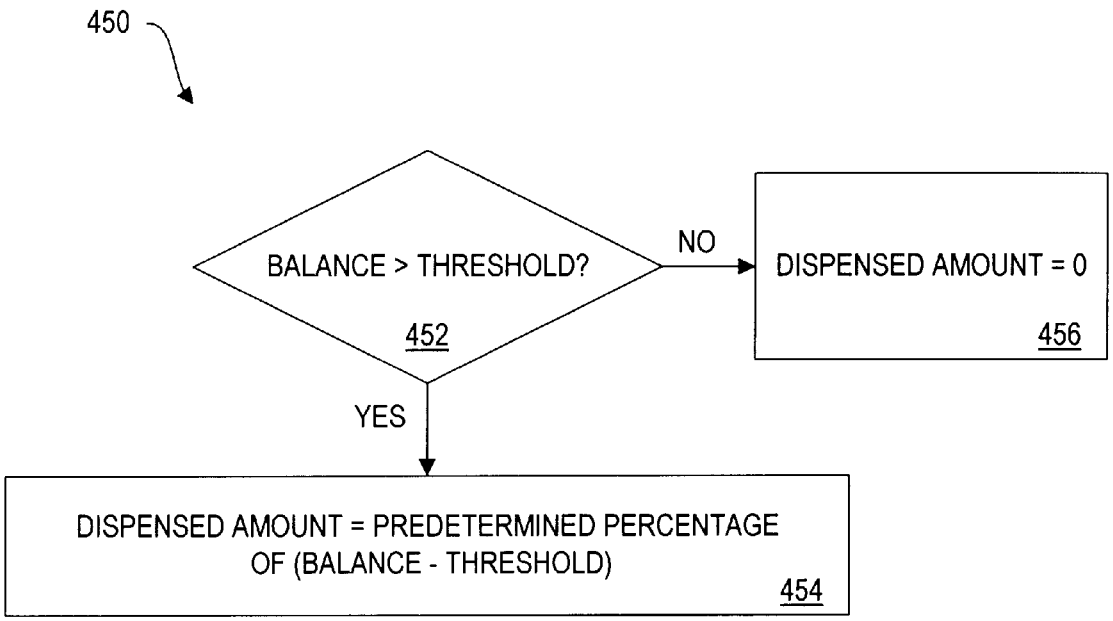
FIG. 11 is a flow chart illustrating a process for determining a dispensed amount in accordance with a second balance management rule.

Referring to FIG. 11, a process 450 for determining a dispensed amount in accordance with such a rule initiates with a determination of whether the balance exceeds the predetermined threshold (step 452). Typically, this determination is made upon each play of the gaming device. If the balance exceeds the predetermined threshold, then the dispensed amount is determined to be the predetermined percentage of the difference between the balance and the predetermined threshold (step 454). Otherwise, the dispensed amount is determined to be zero (step 456), and nothing is automatically dispensed.

Another balance management rule may specify that the dispensed amount be a predetermined percentage of the winning amount earned after each play. For example, the rule may specify that half of each winning amount is dispensed after each play. In accordance with such a rule, if the predetermined percentage is 50%, and a play results in a winning amount of $70, then the dispensed amount is $35 (50% of $70=$35). The undispensed portion of the winning amount ($35) would be added to the balance.

In one embodiment, the balance management rules may be implemented only after a predetermined number of plays, or after a predetermined time period. For example, one balance management rule may be implemented an hour after a balance is established, or after one hundred plays.

As described above, many players want to play with "house money" (money awarded while playing) and not "their own" money. For example, a player that establishes an initial balance with $20 may accumulate a balance of $50 after one or more plays. The player may consider $30 ($50–$20) to be an "available amount" to wager with. Accordingly, the present invention facilitates such a playing strategy by allowing the player to have $20 dispensed, and thereby leave the available amount ($30) for subsequent play.

In addition, a gaming device provided in accordance with the present invention may further prevent selection of a wager amount that is greater than the available amount. For example, if the balance is $50 and a predetermined threshold is $20, then the corresponding available amount is $30 ($50–$20). Any attempt by the player to select a wager amount greater than $30 would generate a displayed message (e.g., "Invalid wager amount, try again"), and the gaming device would wait until the player selects a wager amount no greater than $30. Thus, the player could play with only "house money", even without having the $20 dispensed. Such a process for preventing selection of wager amounts greater than the available amount may be implemented as a type of balance management rule.

Figure 12:
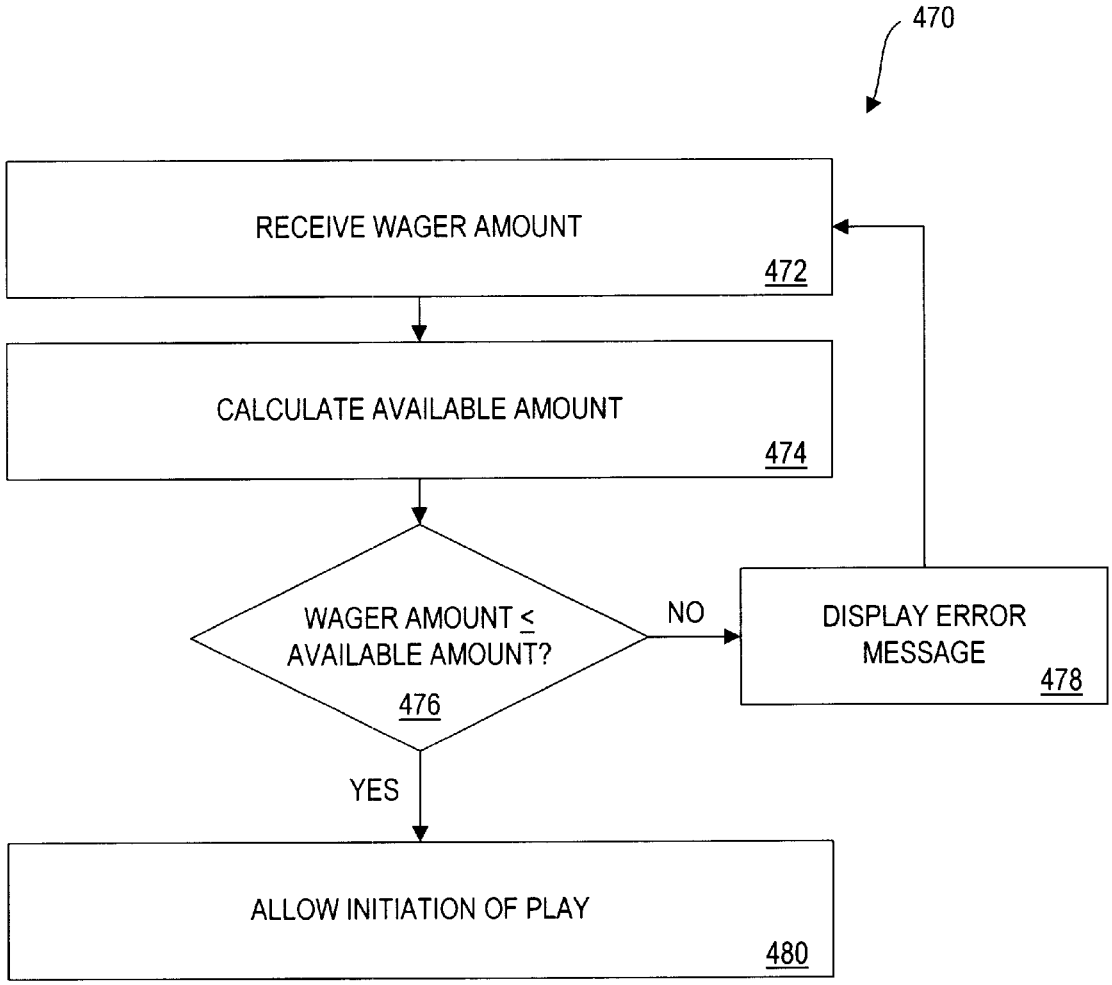
FIG. 12 is a flow chart illustrating a process for preventing selection of a wager amount that is greater than an available amount.

Referring to FIG. 12, a process 470 initiates when the gaming device receives a wager amount from the player (step 472). The gaming device also calculates the available amount by subtracting a predetermined threshold from the balance (step 474). If the wager amount is greater than the available amount, an appropriate error message is displayed to the player (steps 476 and 478), and the gaming device waits for another wager amount to be received (step 472). If the wager amount is not greater than the available amount, the gaming device allows initiation of play (step 480).

Those skilled in the art will note that various substitutions may be made to those embodiments described herein without departing from the spirit and scope of the present invention. For example, although a slot machine has been described above, the present invention is equally applicable to other gaming devices, such as video poker machines and video blackjack machines.

What is claimed is:

1. A method for operating a gaming device to provide a monetary output, comprising:

determining a balance credited to a player of the gaming device;

determining a dispensed amount that is less than the balance;

dispensing an amount of currency that is based on the dispensed amount; and adjusting the balance by the dispensed amount.

2. The method of claim 1, in which the step of dispensing an amount of currency comprises:

activating a hopper to dispense the amount of currency that is based on the dispensed amount.

3. The method of claim 1, in which the step of determining a dispensed amount that is less than the balance comprises: receiving a signal specifying the dispensed amount.

4. The method of claim 1, in which the step of determining a dispensed amount that is less than the balance comprises:

determining the dispensed amount in accordance with a balance management rule.

5. The method of claim 4, in which the balance management rule specifies that the dispensed amount be a difference between the balance and a predetermined threshold.

6. The method of claim 5, in which the predetermined threshold is an initial balance.

7. The method of claim 4, in which the balance management rule specifies that the dispensed amount be a predetermined percentage of a difference between the balance and a predetermined threshold.

8. The method of claim 1, in which the step of adjusting the balance by the dispensed amount comprises:

decreasing the balance by the dispensed amount.

9. An apparatus for operating a gaming device to provide a monetary output, comprising:

a processor; and a memory in communication with the processor, the memory storing a program, and the processor operative with the program to determine a balance credited to a player of the gaming device;

determine a dispensed amount that is less than the balance;

dispense an amount of currency that is based on the dispensed amount; and adjust the balance by the dispensed amount.

10. A method for operating a gaming device to provide a monetary output, comprising:

establishing a balance credited to a player of the gaming device;

initiating a play of the gaming device, the play having a corresponding wager amount and winning amount;

adjusting the balance in dependence on the wager amount and the winning amount, thereby generating a first adjusted balance;

determining a dispensed amount that is less than the first adjusted balance;

dispensing an amount of currency that is based on the dispensed amount; and adjusting the first adjusted balance by the dispensed amount, thereby generating a second adjusted balance.

11. The method of claim 10, in which the step of dispensing an amount of currency comprises:

activating a hopper to dispense the amount of currency that is based on the dispensed amount.

12. The method of claim 10, in which the step of determining a dispensed amount that is less than the first adjusted balance comprises:

receiving a signal that specifies the dispensed amount.

13. The method of claim 10, in which the step of determining a dispensed amount that is less than the first adjusted balance comprises:

determining the dispensed amount in accordance with a balance management rule.

14. The method of claim 13, in which the balance management rule specifies that the dispensed amount be a difference between the first adjusted balance and a predetermined threshold.

15. The method of claim 14, in which the predetermined threshold is an initial balance.

16. The method of claim 13, in which the balance management rule specifies that the dispensed amount be a predetermined percentage of a difference between the first adjusted balance and a predetermined threshold.

17. The method of claim 13, in which the balance management rule specifies that the dispensed amount be a predetermined percentage of the winning amount.

18. The method of claim 10, in which the step of adjusting the first adjusted balance by the dispensed amount comprises:

decreasing the first adjusted balance by the dispensed amount.

19. The method of claim 10, further comprising:

preventing selection of a wager amount that is greater than an available amount, the available amount being a difference between the balance and a predetermined threshold.

20. An apparatus for operating a gaming device to provide a monetary output, comprising:

a processor; and a memory in communication with the processor, the memory storing a program, and the processor operative with the program to establish a balance credited to a player of the gaming device;

initiate a play of the gaming device, the play having a corresponding wager amount and winning amount;

adjust the balance in dependence on the wager amount and the winning amount, thereby generating a first adjusted balance;

determine a dispensed amount that is less than the first adjusted balance;

dispense an amount of currency that is based on the dispensed amount; and adjust the first adjusted balance by the dispensed amount, thereby generating a second adjusted balance.

* * * * *